US009890648B2

(12) United States Patent
Spracher et al.

(10) Patent No.: US 9,890,648 B2
(45) Date of Patent: Feb. 13, 2018

(54) TURBINE ROTOR RIM SEAL AXIAL RETENTION ASSEMBLY

(75) Inventors: David Randolph Spracher, Simpsonville, SC (US); John Wesley Harris, Jr., Taylors, SC (US); Zachary James Taylor, Greenville, SC (US); Ryan Zane Ziegler, Simpsonville, SC (US); Bruce John Badding, Simpsonville, SC (US)

(73) Assignee: General Electric Company, Schnectady, NY (US)

( * ) Notice: Subject to any disclaimer, the term of this patent is extended or adjusted under 35 U.S.C. 154(b) by 1649 days.

(21) Appl. No.: 13/344,296

(22) Filed: Jan. 5, 2012

(65) Prior Publication Data

US 2013/0175230 A1 Jul. 11, 2013

(51) Int. Cl.
*F01D 5/32* (2006.01)

(52) U.S. Cl.
CPC ..... *F01D 5/326* (2013.01)

(58) Field of Classification Search
CPC ..... F01D 5/326; F01D 5/32; F01D 5/3038
USPC ..... 416/215, 220 R, 204 A, 248, 219 R
See application file for complete search history.

(56) References Cited

U.S. PATENT DOCUMENTS

| | | | | |
|---|---|---|---|---|
| 4,676,723 | A | 6/1987 | Kiger et al. | |
| 4,767,275 | A * | 8/1988 | Brown | 416/220 R |
| 6,190,131 | B1 | 2/2001 | Deallenbach | |
| 6,814,538 | B2 | 11/2004 | Thompson | |
| 7,435,055 | B2 * | 10/2008 | Hansen et al. | 416/215 |
| 7,931,442 | B1 * | 4/2011 | Liang | 416/193 A |
| 8,007,230 | B2 | 8/2011 | Hefner | |
| 8,007,245 | B2 | 8/2011 | Brittingham et al. | |
| 8,061,995 | B2 | 11/2011 | Prince et al. | |
| 8,075,272 | B2 | 12/2011 | Riaz et al. | |
| 8,096,775 | B2 | 1/2012 | Riaz et al. | |
| 2002/0182081 | A1 * | 12/2002 | Bachofner et al. | 416/220 R |
| 2009/0290983 | A1 * | 11/2009 | Tanaka | 416/179 |

FOREIGN PATENT DOCUMENTS

| | | |
|---|---|---|
| RU | 2296889 C2 | 4/2007 |
| RU | 2413073 C2 | 2/2011 |

OTHER PUBLICATIONS

U.S. Appl. No. 13/344,296, filed Jan. 5, 2012 (pending).
U.S. Appl. No. 12/078,758, filed Apr. 4, 2008 (pending).
U.S. Appl. No. 13/116,068, filed May 26, 2011 (pending).
Decision to Grant a Patent for an Invention dated Mar. 23, 2017 issued in Russian Application No. 2012158311/06 with English translation (12 pages).

* cited by examiner

*Primary Examiner* — Justin Seabe
(74) *Attorney, Agent, or Firm* — Nixon & Vanderhye P.C.

(57) ABSTRACT

A retention device for maintaining a first rotary machine component axially loaded onto a second rotary machine component in a fixed axial position includes a lock block sized and configured to move between first and second aligned recesses in the first and second rotary machine components. The aligned recesses are shaped to prevent rotation of the lock block, and the lock block has a threaded bore extending therethrough. An actuator is threadably mounted in the bore, such that rotation of the actuator will, in use, move the lock block from the first aligned recess at least partially into the second aligned recess.

20 Claims, 8 Drawing Sheets

TURBINE ROTOR RIM SEAL AXIAL RETENTION ASSEMBLY

BACKGROUND OF THE INVENTION

The present invention relates generally to turbine rotors and, more specifically, to a system for the axial retention of a turbine rotor rim seal mounted on a turbine rotor spacer disk.

Turbine rotor spacer disks are provided with a plurality of rim seals in the form of arcuate seal segments, which, when installed, form a 360° seal. Each seal segment (or, simply, seal or rim seal) is secured to the spacer disk by means of mating dovetail surface features that are configured to enable axial loading of the rim seals onto the spacer disk. Once the rim seals are installed on the spacer disk, there is only limited access to the dovetail area. At the same time, however, the rim seals must be retained axially to prevent slip particularly during engine shipment/operation. Because of the limited access, conventional axial retention schemes cannot be employed.

There remains a need, therefore, for a simple, low-cost yet effective arrangement for retaining an entire circumferential set of rim seals individually and collectively on a rotor spacer disk so as to prevent undesirable axial shifting of any one or more of the seals.

BRIEF DESCRIPTION OF THE INVENTION

In a first exemplary but nonlimiting embodiment, there is provided a retention device for maintaining a first rotary machine component axially loaded onto a second rotary machine component in a fixed axial position, the retention device comprising a block sized and configured to move between first and second aligned recesses in the first and second rotary machine components, the aligned recesses shaped to prevent rotation of the block, the block having a threaded bore extending therethrough; and an actuator threadably mounted in the bore, such that rotation of the actuator will, in use, move the block from the first aligned recess at least partially into the second aligned recess.

In another aspect, the invention relates to an axial retention system for a plurality of rim seals axially loaded onto a rotor spacer disk, the axial retention system comprising a shear key adapted to be inserted between an annular circumferential groove in the rotor spacer disk and a radial notch formed in a circumferential end face of the rim seal; and a lock block sized and configured to move between first and second recesses formed, respectively, in the rotor spacer disk and said rim seal when the rim seal is loaded axially onto the rotor spacer disk, the lock block provided with an actuator adapted to move the lock block into a position straddling the first and second recesses.

In still another exemplary but nonlimiting embodiment, the invention relates to an axial retention system for a plurality of rim seals axially loaded onto a rotor spacer disk, the axial retention system comprising for each rim seal except for a finally-installed locker seal, a shear key adapted to be inserted between an annular circumferential groove in the spacer disk and a radial notch formed in an end face of the rim seal; and a back-up stop pin extending from the end face and receivable in a notch formed in an end face of a next-adjacent rim seal.

The invention will now be described in greater detail in connection with the drawings identified below.

DETAILED DESCRIPTION OF THE INVENTION

In the exemplary but nonlimiting embodiment, the axial retention system for the rotor spacer disk rim seals is made up of three components. As will be explained in further detail below, not all of the components are used with every rim seal. In this regard, it will be appreciated that the rim seals are loaded axially onto the spacer disk. The assembly is done in a sequential manner, and the system as disclosed herein utilizes at least two of the components for all but the finally-installed rim seal. A third component is employed with the finally-installed seal (also referred to as the "locker seal") to effectively lock the entire array of seals to the spacer disk.

Figure 1:
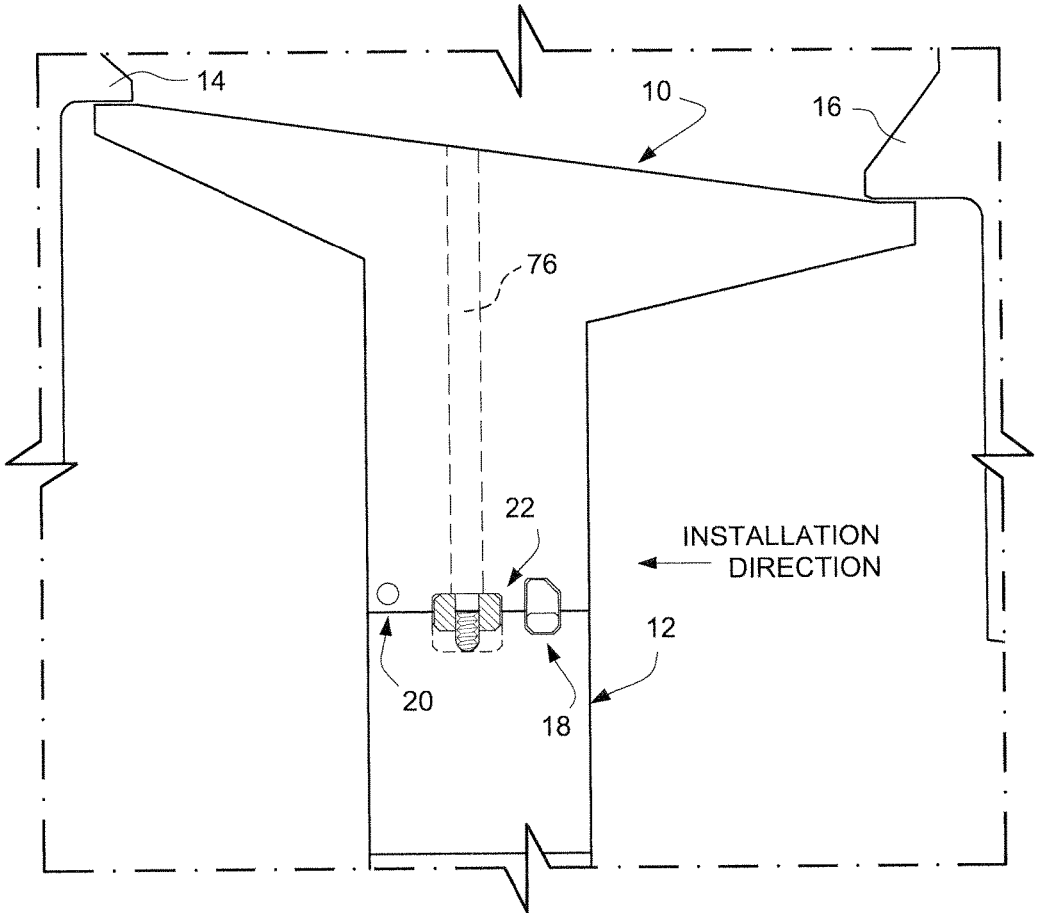
FIG. 1 is a schematic diagram illustrating a rotor spacer disk rim seal in combination with axial movement prevention devices selectively employed with rim seals installed about the spacer disk.
Figure 2:
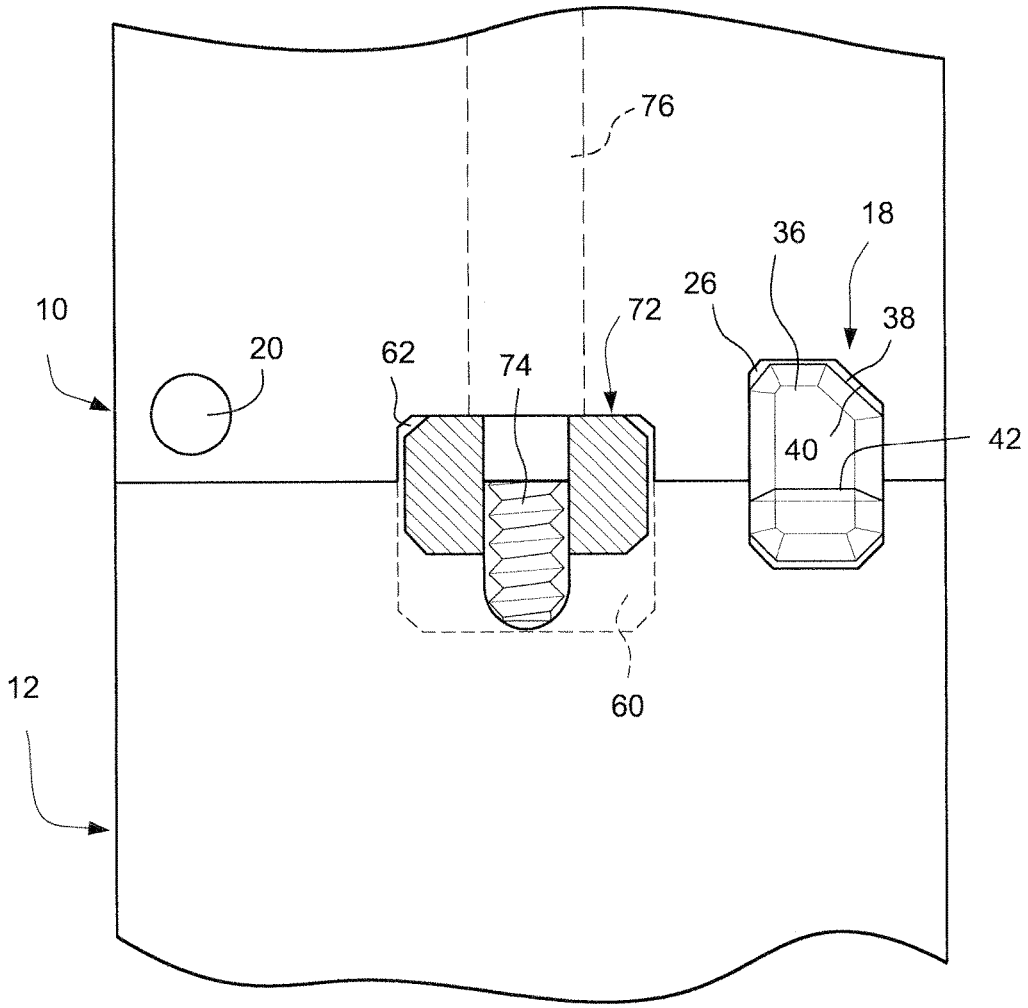
FIG. 2 is an enlarged detail taken from FIG. 1.

Thus with reference initially to FIGS. 1 and 2, a rim seal 10 is shown, in schematic form, axially loaded onto the rotor spacer disk 12. The rim seal 10 interfaces with adjacent turbine components 14, 16, as is well understood in the art. As illustrated, the loading or installation direction is from right-to-left. The three axial retention components in accordance with the exemplary but nonlimiting embodiment, include a shear key 18, a back-up pin 20 and a locker "puck" (also referred to herein as a lock block) 22. FIGS. 1 and 2 are intended to show the components utilized during installation for convenience and ease of understanding but, for all but one of the rim seals 10 loaded onto the spacer disk 12, only the shear key 18 and back-up pin 20 are utilized. The last rim seal or locker seal 10 installed on the spacer disk utilizes the locker puck 22, but not the shear key 18 or back-up pin 20, as further explained below.

Figure 3:
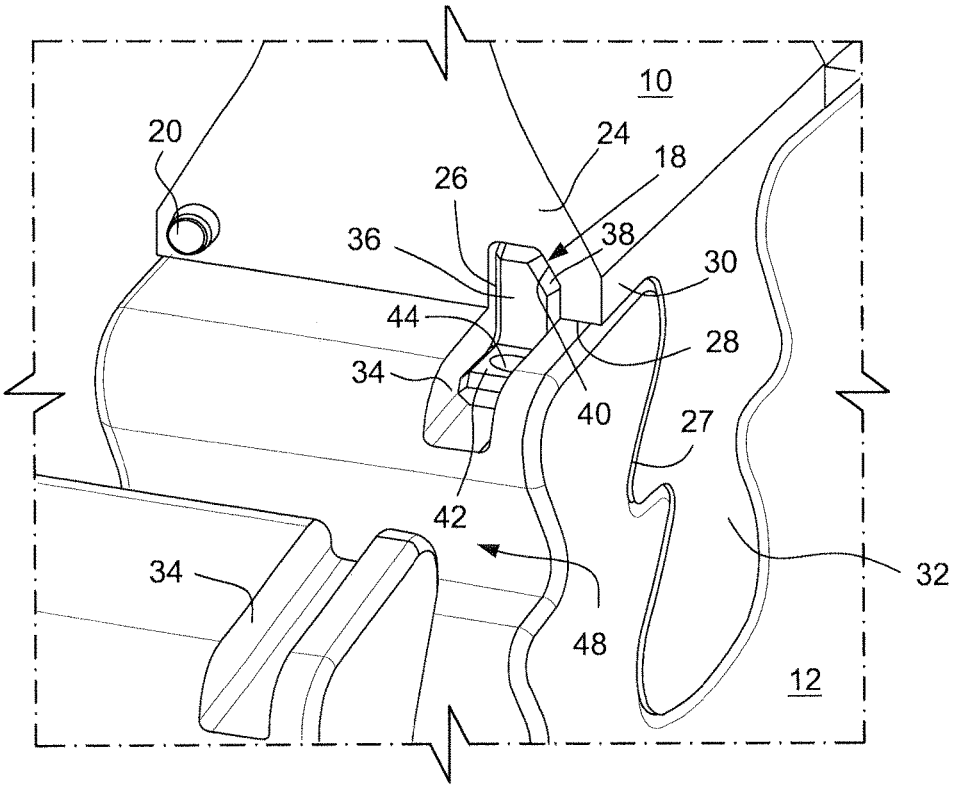
FIG. 3 is a partial perspective view of the turbine spacer disk with a rim seal installed, utilizing two of the three retention components shown in FIG. 1.
Figure 4:
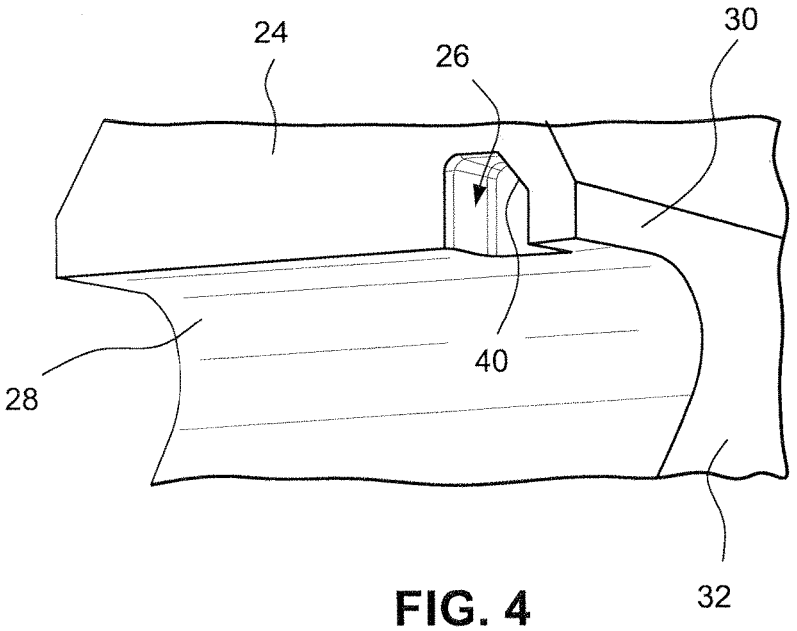
FIG. 4 is a partial perspective view illustrating in isolation, a stop key notch formed in the end face of the rim seal shown in FIG. 3.

With reference now also to FIGS. 3 and 4, one circumferential end face 24 of the rim seal 10 is formed with a radially-oriented notch 26 adjacent the entry end of the spacer disk slot 27, opening from the bottom surface 28 of a flange portion 30 of the rim seal as well as from the end face 24. The notch 26 is otherwise closed in circumferential and axial directions. The notch 26 is located to align radially with a discontinuous annular groove 34 formed in the spacer disk 12 upon installation of the rim seal 10 (sometimes referred to herein simply as "the seal 10"). It will be appreciated that the groove 34 and notch 26 may be located further away from the entry end of the disk slot 27 if desired.

Figure 5:
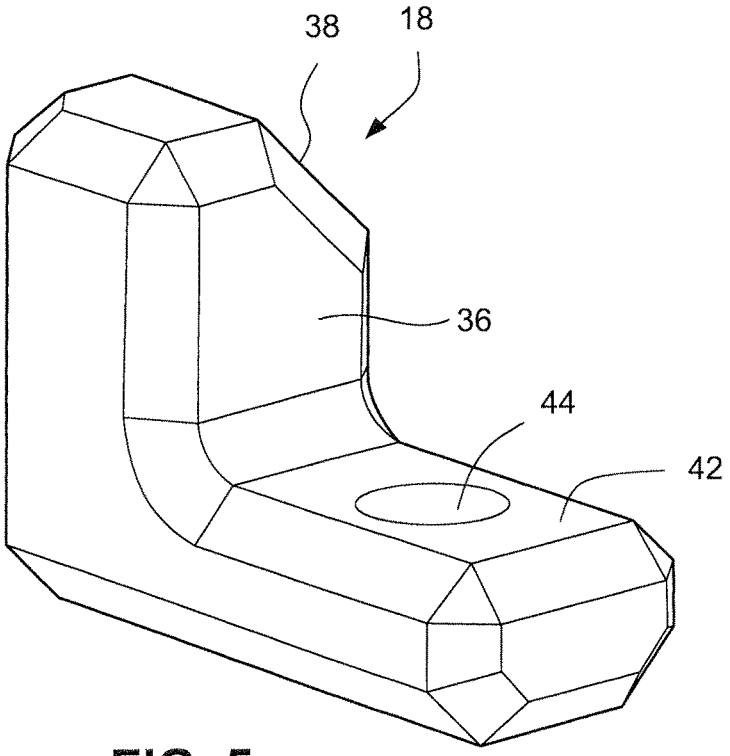
FIG. 5 is a perspective view of the stop key taken from FIG. 3.

The L-shaped shear key 18 (see also FIG. 5) is located in the groove 34 and notch 26 as best seen in FIG. 3. The dimensions and shape of the shear key 18 are such that it can be located in only one orientation, making installation fool-proof. More specifically, the radially outwardly extending leg or stem 36 of the L-shaped shear key is formed with an angled corner 38 that mates with a correspondingly-shaped angled corner 40 of the notch 26. The horizontal (or circumferential) leg or base 42 of the L-shaped shear key 18 sits in the groove 34. It will be appreciated that the shear key 18 can be located in the groove 34 and notch 26 after the seal 10 is axially loaded onto the spacer disk 12 or, alternatively, the shear key 18 can be located in the groove 34, laterally away from the seal 10 and moved into engagement with the notch 26 after the seal 10 is installed.

Note also the aperture 44 formed in the base 42 of the shear key 18. This allows easy removal of the shear key with the use of a suitable tool (not shown). It is not necessary, however, to secure or fix the shear key 18 within the notch 26 and/or groove 34. Since the next adjacent rim seal abuts the rim seal 10 and overlies the base 42 of the key 18, further movement of the shear key is precluded. The shear key 18 thus prevents movement of the rim seal 10 in either axial direction, and the shear key is itself locked into place by the next adjacent seal.

The circumferential end face 24 of the seal 10 is also formed with a blind bore 46 (FIG. 6) at the opposite end of the face 24 from the shear key 18. The bore 46 receives the back-up stop pin 20 (cylindrical in the example embodiment) via a press fit, or by other suitable means, leaving a portion of the pin 20 exposed. Like the shear key 18, the stop pin 20 prevents axial movement of the rim seal 10 in at least one axial direction, as described further below, thus providing a back-up function in the event that the shear key 18 has been inadvertently omitted during installation of the seal.

Figure 6:
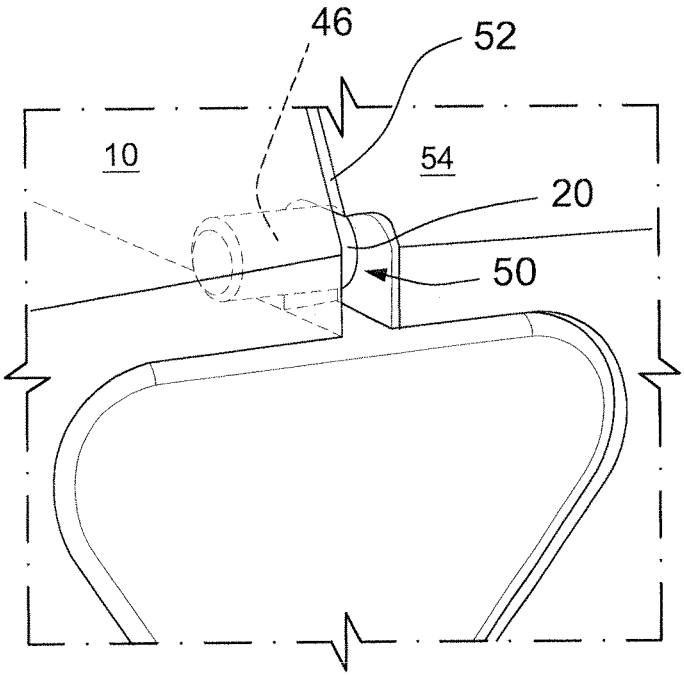
FIG. 6 is a partial perspective view showing the interaction of a stop pin on one rim seal engaged within a notch formed in an adjacent rim seal.
Figure 7:
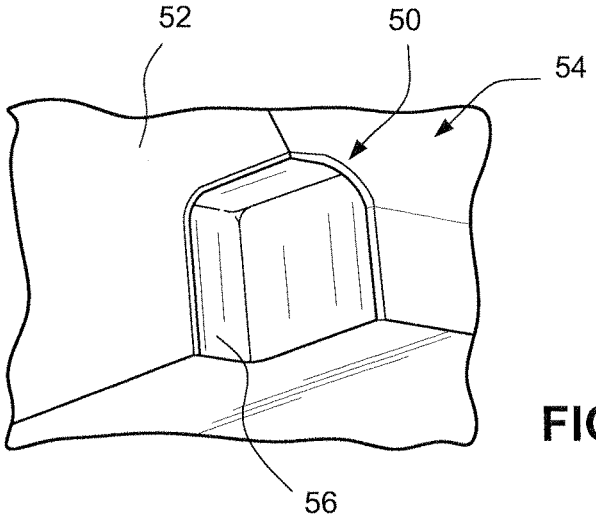
FIG. 7 is a partial perspective view illustrating the notch formed in the rim seal that receives the stop pin as shown in FIG. 6.

With reference specifically to FIGS. 3 and 6, it will be appreciated that the next adjacent seal can be slid axially along its dovetail groove 48 formed in the spacer disk, passing by (and over) the base 42 of the shear key 18 and stopping when the axial stop pin 20 engages within an open notch 50 (FIGS. 6, 7) formed in the circumferential end face 52 of a next adjacent seal 54. The notch wall 56 thus serves as the stop limit for the axial installation movement in one direction of the next adjacent seal, and the next-installed shear key then also precludes any axial movement in both the installation and opposite directions.

Figure 8:
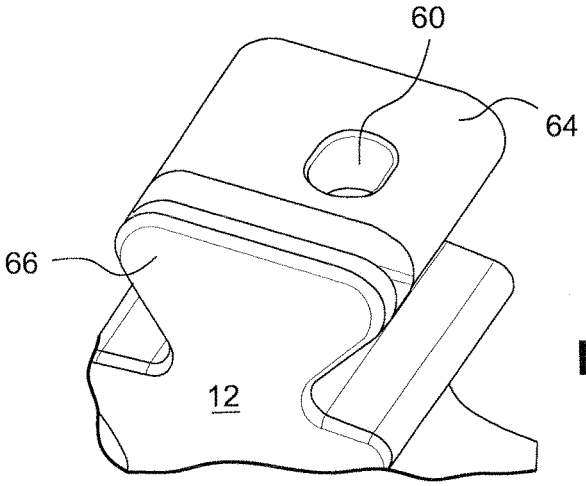
FIG. 8 is a partial perspective view illustrating a locker puck recess formed in the spacer disk.
Figure 9:
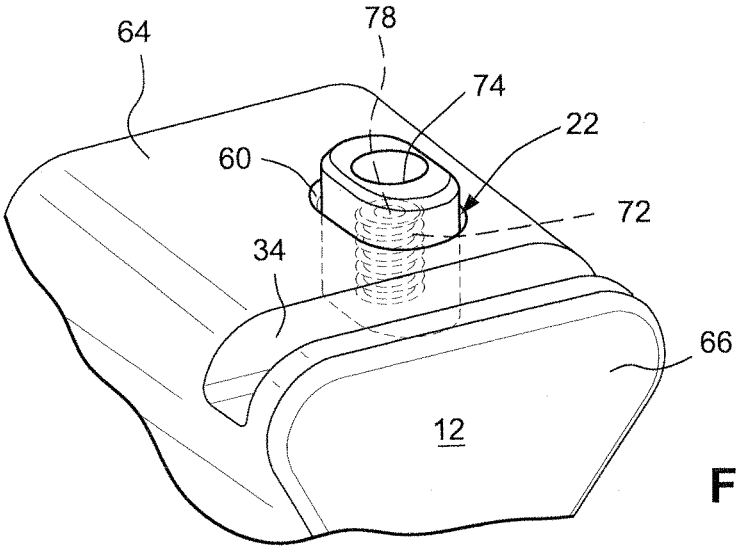
FIG. 9 is a perspective view illustrating a locker puck partially received within the recess shown in FIG. 8 but from a different vantage point.
Figure 10:
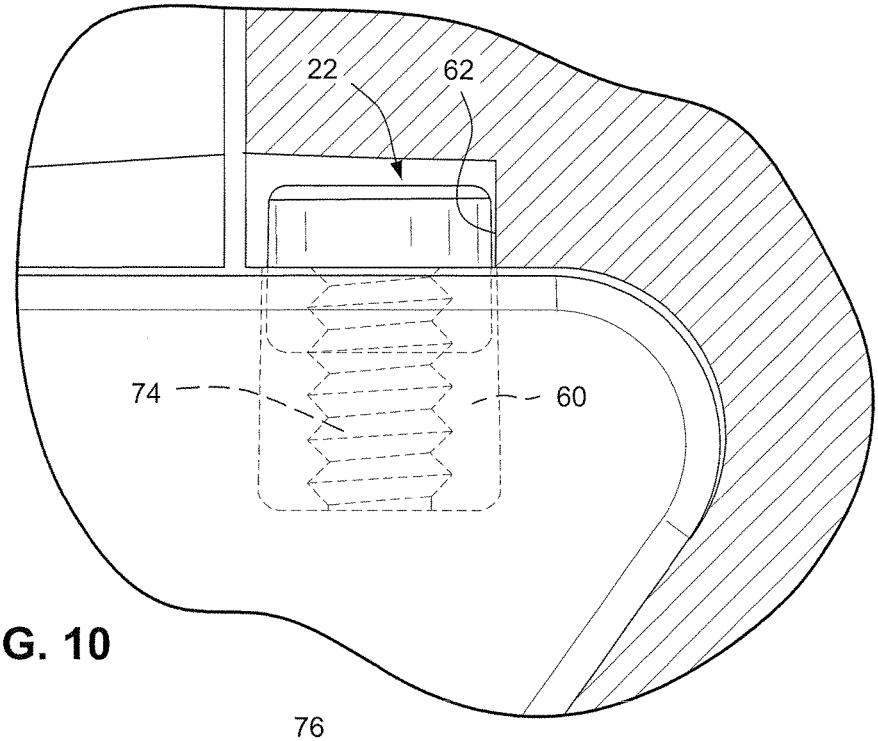
FIG. 10 is a section view showing the locker puck of FIG. 9 in combination with a rim seal installed on the spacer disk.
Figure 11:
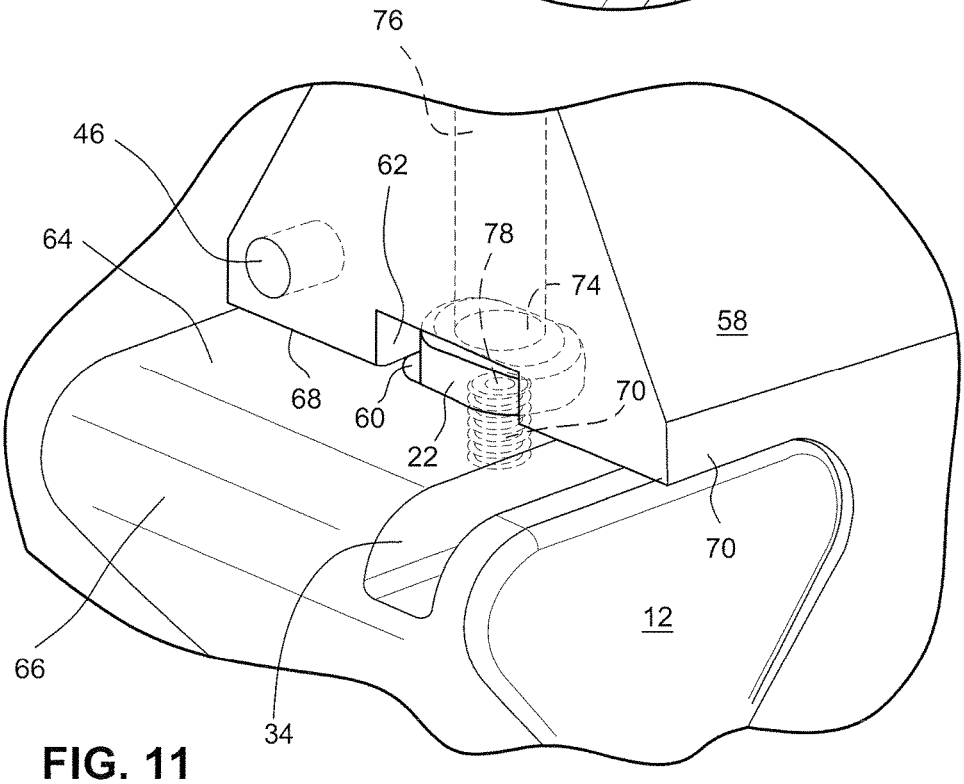
FIG. 11 is a partial perspective view illustrating the locker puck located between the rim seal and the spacer disk.

Now with reference to FIGS. 8-11 in order to lock the final seal 58 in place, the third retention component is utilized. An oblong or oval locker "puck" 22 is shaped and sized to fit in and between vertically-adjacent, recesses 60, 62 formed in the spacer disk 12 and seal 58, respectively. More specifically, the oblong or oval recess 60 is formed in the upper (radially outer) surface 64 of the spacer disk post 66 (FIG. 8). The recess 62 (FIGS. 10-11) is formed in the radially inner surface 68 of the seal flange portion 70, the recesses 60 and 62 vertically (or radially) aligning when the seal 58 is loaded into the spacer disk 12.

A threaded bore 72 extends vertically or radially through the puck 22 and a threaded adjustment stud or screw 74 extends through the puck 22. A bore 76 may be formed in the seal and extends radially outwardly to an access location, where a tool may be inserted. The tool is designed to engage a surface feature 78 (e.g., an Allen-wrench recess) formed in the end of the stud or screw 74. When the stud 74 is rotated by the tool, the puck 22 moves along the stud because the puck is held in a non-round recess. Thus, rotation of the stud 74 in a clockwise direction causes the puck 22 to move radially outward to the position shown in FIGS. 9-11, where the puck is partially-engaged in both recesses 60, 62. The locker puck 22 thus locks the final seal 58 in place and, in so doing, in combination with the shear keys and back-up pins, locks all of the rim seals against any axial movement within the spacer disk 12. Note in this regard that if all of the shear keys were omitted, all of the seals except the finally-installed seal would be locked in one axial direction only, because the back-up pins prevent axial movement in only one direction.

Note also that for the final rim seal 58, neither shear key 18 nor the back up pin 20 are used.

Figure 12:
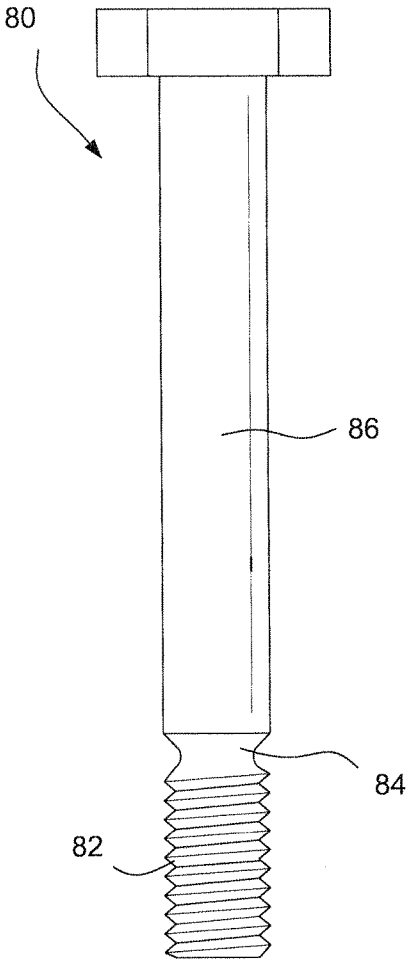
FIG. 12 illustrates a bolt actuator in accordance with another exemplary embodiment.
Figure 13:
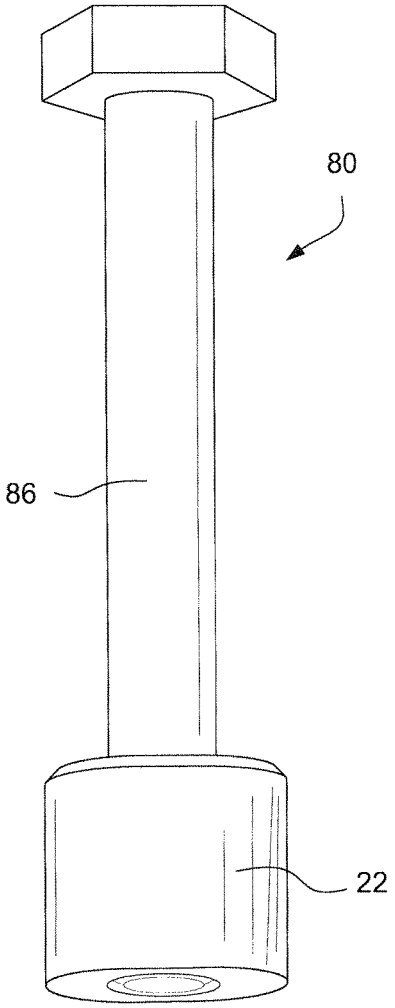
FIG. 13 illustrates the bolt of FIG. 12 with a locker puck attached.

Alternatively, an elongated bolt 80 (FIGS. 12, 13) with a threaded end 82 may be used to engage the puck 22. The bolt 80 will extend through the bore 76 and rotation of the bolt will cause the puck 22 to move axially along the threaded end 82 (and radially relative to the spacer disk) substantially as described above. A fail or weak point in the form of groove 84 may be provided in the bolt shank 86 adjacent the threaded end 82 to facilitate breaking and removal of the bolt shank after installation if desired.

Figure 14:
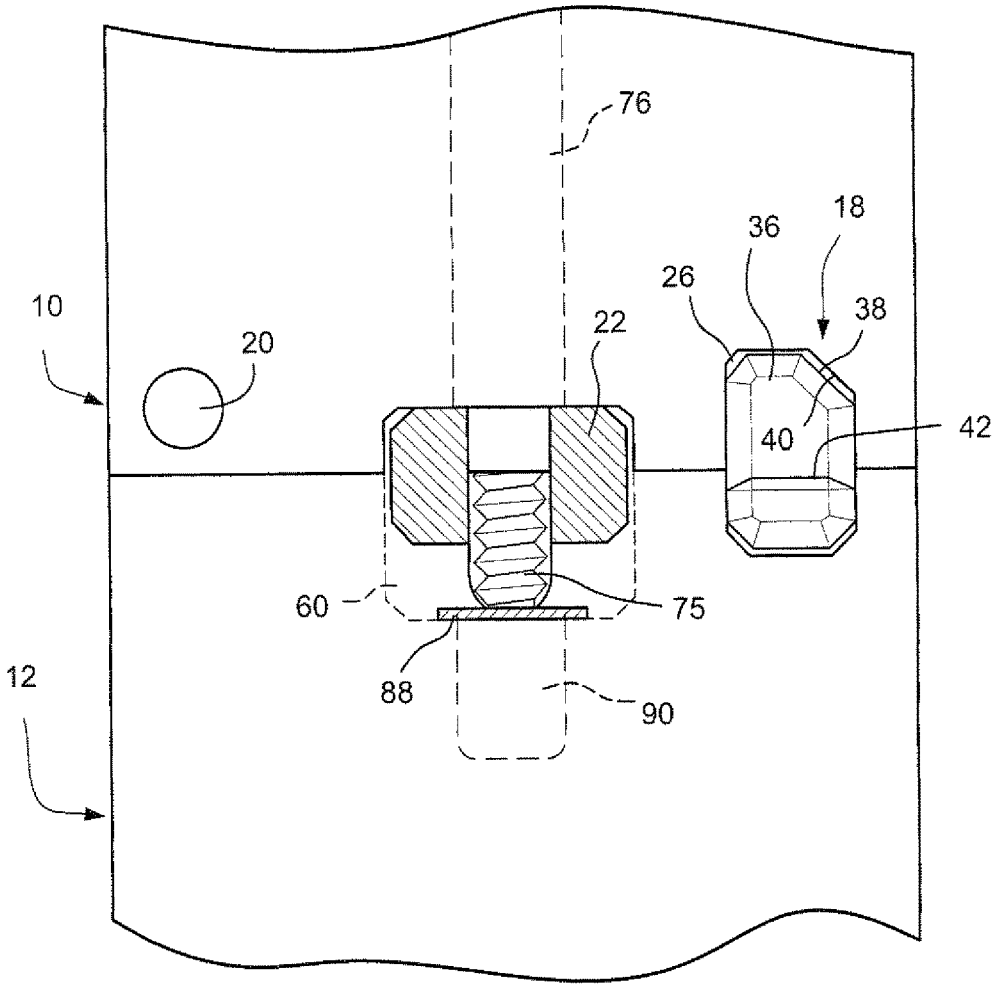
FIG. 14 illustrates an axial movement prevention device employed with rim seals installed about the spacer disk in accordance with an alternative exemplary embodiment.

In another alternative arrangement, a frangible shim 88 is integrally attached to the lower part of the threaded shank 75 as shown in FIG. 14, in conjunction with an extended receptacle portion 90 provided in the disk, radially inward of the recess 60. This allows the shank 75 to be punched radially into the receptacle portion 90, causing the puck 22 to fall back into the rotor disk, thus providing an alternative technique for releasing the rim seal for axial movement.

With the above-described arrangement, all components, i.e., the shear key 36, locker puck 22 and stop pin 20 are enclosed within the rim seal/spacer disk so that in the event of failure, the components are substantially precluded from dropping into the internal wheel space of the rotor.

It will also be appreciated that the locker puck 22 may be utilized in the three-component system as described above, or, alternatively, as a stand-alone retention device used in connection with any one or all of the rim seals. Moreover, the locker puck 22 can be employed in any other application where retention of one component in a slot formed in a second component is desired.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A retention device for maintaining a second rotary machine component axially loaded onto a first rotary machine component in a fixed axial position, the retention device comprising:

a block sized and configured to move between first and second aligned recesses in the first and second rotary machine components, the first aligned recess being completely within a radially outer surface of the first rotary machine component, the aligned recesses being shaped to be complementary to the block to prevent rotation of said block, said block having a threaded bore extending at least partially therethrough; and an actuator threadably mounted in said bore, such that rotation of said actuator will, in use, move said block from a first position being completely within the first aligned recess to a second position at least partially in said second aligned recess;

wherein:

outer boundaries of the first and second recesses are radially aligned.

2. The retention device of claim 1 wherein said actuator comprises a stud engageable by a tool.

3. The retention device of claim 1 wherein said actuator comprises an elongated bolt with a threaded end adapted to be received in said bore.

4. The retention device of claim 1 wherein said block is oblong or oval-shaped.

5. The retention device of claim 1 wherein said first rotary component comprises a rotor spacer disk rim seal and said second rotary component comprises a rotor spacer disk.

6. An axial retention system for a plurality of rim seals axially loaded onto a rotor spacer disk, the axial retention system comprising:

a shear key adapted to be inserted between an annular circumferential groove in said rotor spacer disk and a radial notch formed in an end face of said rim seal;

a lock block sized and configured to move between first and second recesses formed, respectively, in said rotor spacer disk and said rim seal when said rim seal is loaded axially onto said spacer disk, said lock block provided with an actuator adapted to move said lock block into a position straddling said first and second recesses; and a back-up stop pin integral with and extending from said end face and receivable in a notch formed in an end face of a next adjacent rim sea, wherein:

radially-oriented boundaries of the first recess and the second recess are aligned radially, the first recess is formed within a rotor spacer disk radially outermost surface, and the first recess and second recess are formed in a shape which is complementary to the block.

7. The axial retention system of claim 6 wherein said shear key is substantially L-shaped, a base portion received in said circumferential groove and an upright stem portion received in said radial notch.

8. The axial retention system of claim 6 wherein said first and second recesses and said lock block are shaped to prevent rotation of said lock block.

9. The axial retention system of claim 8 wherein said lock block is formed with a threaded bore extending at least partially therethrough.

10. The retention device of claim 9 wherein said actuator comprises a stud engageable by a tool.

11. The retention device of claim 9 wherein said actuator comprises an elongated bolt with a threaded end adapted to be received in said bore.

12. The retention device of claim 8 wherein said block is oblong or oval-shaped.

13. An axial retention system for a plurality of rim seals axially loaded onto a rotor spacer disk, the axial retention system comprising:

for each rim seal except for a finally-installed locker seal, a shear key adapted to be inserted between an annular circumferential groove in said rotor spacer disk and a radial notch formed in an end face of said rim seal; and a back-up stop pin integral with and extending from said end face and receivable in a notch formed in an end face of a next-adjacent rim seal.

14. The axial retention of claim 13 wherein said finally-installed locker seal is also provided with a lock block sized and configured to move between first and second recesses formed, respectively, in said spacer disk and said rim seal when said finally-installed rim seal is loaded axially onto said spacer disk, said lock block provided with an actuator adapted to move said lock block into a position straddling said first and second recesses, thereby locking said rim seal to said spacer disk.

15. The axial retention system of claim 14 wherein said first and second recesses and said lock block are shaped to prevent rotation of said lock block.

16. The axial retention system of claim 15 wherein said lock block is formed with a threaded bore extending at least partially therethrough for receiving said actuator.

17. The retention device of claim 16 wherein said actuator comprises a stud engageable by a tool.

18. The retention device of claim 16 wherein said actuator comprises an elongated bolt with a threaded end adapted to be received in said threaded bore.

19. The retention device of claim 17 wherein said first recess in said spacer disk is provided with an extended receptacle portion covered by a frangible shim, said extended receptacle adapted to receive said stud to thereby permit said lock block to move from said position straddling said first and second recesses to a release position where said lock block is seated entirely within said second recess.

20. A system for providing retention of a first rotary component on a second rotary component, the first rotary component being the last in a series of first rotary components installed circumferentially around a respective series of second rotary components, comprising:

a radially outer surface of the second rotary component comprising a recess within a face of the radially outer surface of the second rotary component, the recess being away from any edge of the radially outer surface of the second rotary component;

a radially inner surface of the first rotary component and a radially oriented surface of the first rotary component which intersects the radially inner surface along a radially inner edge, a recessed notch being formed along a radially inner edge between the radially oriented surface of the first rotary component and the radially inner surface of the first rotary component;

a locker puck configured to correspond in shape to the recess within the face of the radially outer surface of the second rotary component such that the locker puck does not rotate when placed into the recess;

a threaded shank with a tool-compatible head, the threaded shank being at most a length corresponding to a depth of the recess within the face of the radially outer surface of the second rotary component, contained wholly within the depth of the recess, and passed through the locker puck; and a shaft through the first rotary component configured to allow a tool configured to interact with the tool-compatible head of the threaded shank;

wherein:

radially-oriented boundaries of the recess and the recessed notch are aligned radially when the first rotary component and the second rotary component are mated; and the locker puck is configured to be moved from a first position entirely within the recess to a second position whereby the locker puck engages both the recess and the recessed notch due to the actuation of the locker puck caused by an interaction between the tool and the tool-compatible head of the threaded shank.

* * * * *